US006030669A

United States Patent [19]

Fascio

[11] Patent Number: 6,030,669

[45] Date of Patent: Feb. 29, 2000

[54] LAMINATED BOWS

[76] Inventor: Carlo Fascio, 23 Vera St., Woodbridge, Canada, L4L 5T1

[21] Appl. No.: 09/041,124

[22] Filed: Mar. 12, 1998

[51] Int. Cl.[7] ..... D04D 7/00; A41H 43/00

[52] U.S. Cl. ..... 428/4; 428/5; 223/46

[58] Field of Search ..... 428/4, 5; 223/46; 28/147

[56] References Cited

U.S. PATENT DOCUMENTS 3,637,455 1/1972 Pearson et al. .
4,449,652 5/1984 Coppins et al. .
4,656,064 4/1987 Cheng .
5,116,687 5/1992 Asano et al. .

*Primary Examiner*—Deborah Jones
*Assistant Examiner*—Jason Savage

[57] ABSTRACT

The present invention relates to decorative bows formed from a folded pattern of a laminated substrate. The substrate comprises one or more layers of printed material laminated between two layers of laminate film so that the print is visible on both sides of the substrate. In order to match the bow to gift wrap the substrate can be formed from gift wrap paper with a protective film laminated to the printed side of the paper. As gift wrap is normally only printed on one side, two sheets of gift wrap are laminated with their unprinted sides together resulting in a substrate having printed material on both sides with a protective film on each side. The gift wrap can be substituted with cardboard, fabric, vinyl, plastic or other film. By laminating the material the resulting bows are waterproof, durable, reusable.

12 Claims, 6 Drawing Sheets

LAMINATED BOWS

BACKGROUND OF THE INVENTION

1. Field of the Invention

This invention relates to decorative bows for use in the basket and gift industries, decoration and display industry and floral trade industry. In particular this invention relates to decorative bows fabricated from laminated gift wrap.

2. Description of the Prior Art

Decorative bows are conventionally made from ribbon and either packaged as a complete bow or a ribbon assembly that can be converted into a bow, i.e. a pull bow. It may be difficult to match the bow to the gift wrap unless a solid colour of ribbon is used for the bow. In addition the bows are typically not waterproof and may not be suitable for outdoor use.

SUMMARY OF THE INVENTION

It is an object of the invention to provide a decorative bow that matches the pattern on gift wrap.

It is a further object of the invention to provide a means for the manufacturer of gift wrap to utilize the paper for new applications.

It is a further object of the invention to provide a decorative bow for indoor or outdoor use that is waterproof, durable and reusable.

Thus in accordance with the present invention there is provided a decorative bow comprising a folded pattern of a laminated substrate, said substrate comprising one or more layers of printed material laminated between two layers of laminate film whereby the printed material is adapted so that the print is visible on both sides of the substrate. The printed material is preferably selected from the group consisting of paper, cardboard, fabric, vinyl, plastic or film and in particular consists of two sheets of gift wrap paper. The laminate film is polypropylene.

In a preferred embodiment the decorative bows according to the present invention comprises a folded bow section, a cap and cord means. The folded bow section comprises a small bow tie overlying a larger bow tie. The cap comprises a smaller yet bow tie to which the cord means is attached and locks the bow section in the folded position.

In accordance with another aspect of the invention there is provided a method of making the laminated decorative bows comprising the steps of: (a) cutting a pattern from a printed laminate material; (b) folding said pattern along designated fold lines to form a bow; and (c) retaining said bow in a folded condition.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
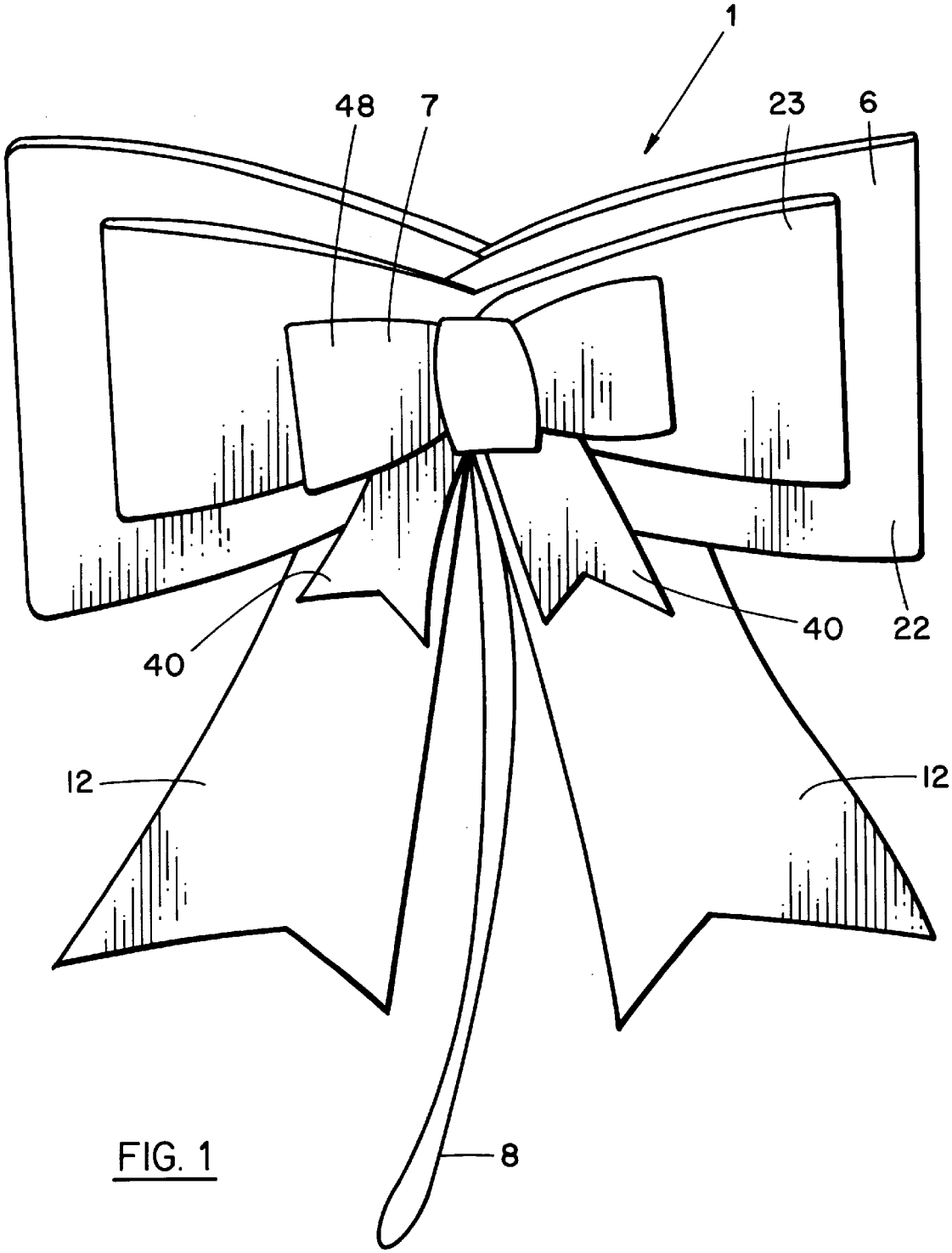
FIG. 1 is a front view of a decorative bow formed of folded laminated gift wrap according to the present invention.
Figure 2:
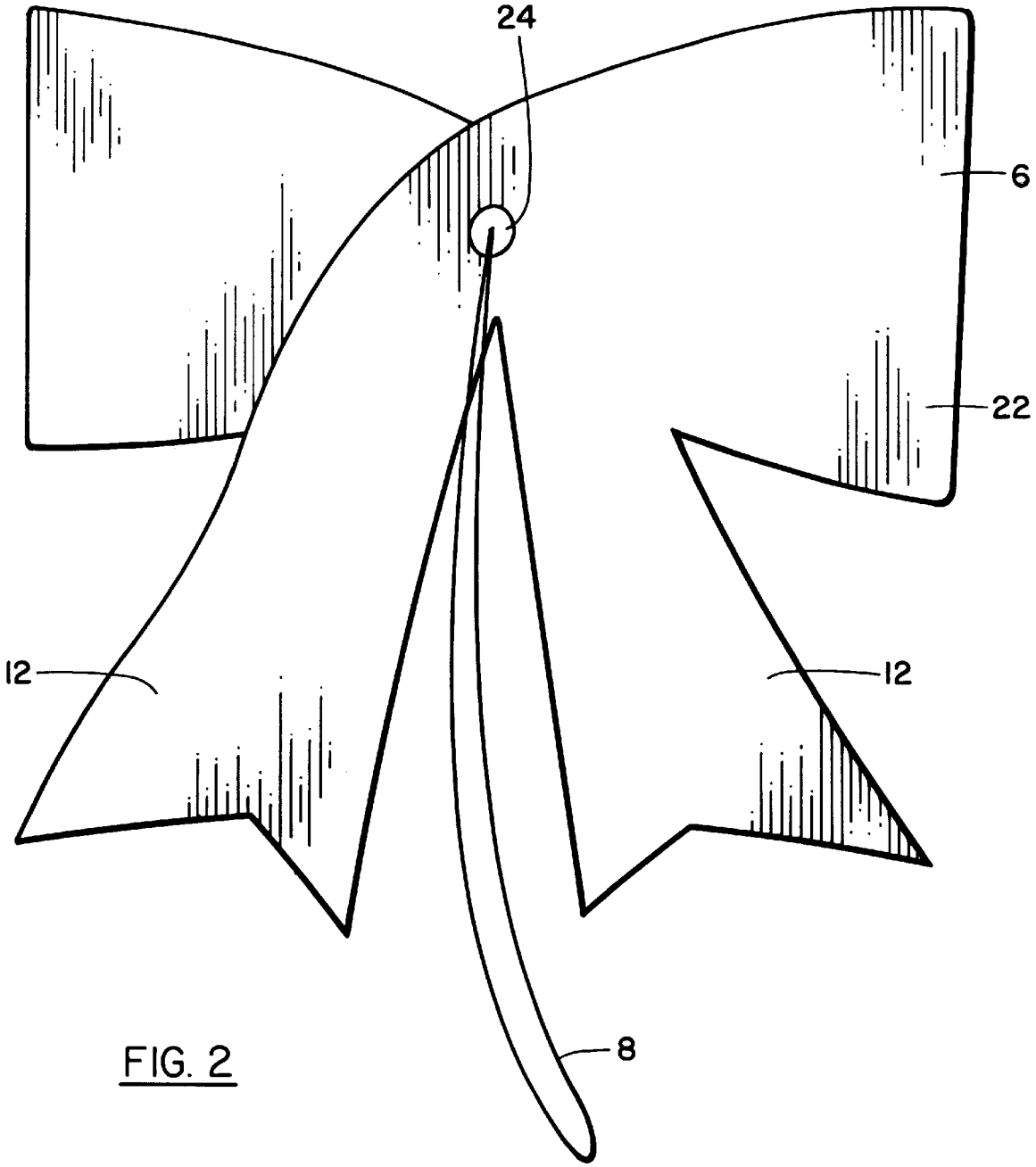
FIG. 2 is a back view of the bow of FIG. 1.

Referring to FIGS. 1 to 6, a decorative bow in accordance with the invention is generally indicated at 1 and is formed from a folded pattern of a laminated substrate 2, said substrate comprising one or more layers of printed material 3 and 4 laminated between two layers of laminate film 5 so that the print is visible on both sides of the substrate. Each decorative bow 1 has a folded bow section 6, a cap 7 and cord means 8 where the folded bow section 6 and cap 7 are made from the laminated substrate 2. In order to match the bow to the gift wrap the substrate 2 can be a laminate material preferably gift wrap paper with a protective film preferably polypropylene laminated to the printed side of the paper. As gift wrap is normally only printed on one side, two sheets of gift wrap are laminated with their unprinted sides together resulting in a substrate having printed material on both sides with a protective film on each side. The gift wrap can be substituted with cardboard, fabric, vinyl, plastic or other film. By laminating the material the resulting bows are waterproof, durable, reusable. In addition laminating the materials stiffens the material (gift wrap, fabric, etc.) so when the bow is formed it has a rigid look.

Figure 3:
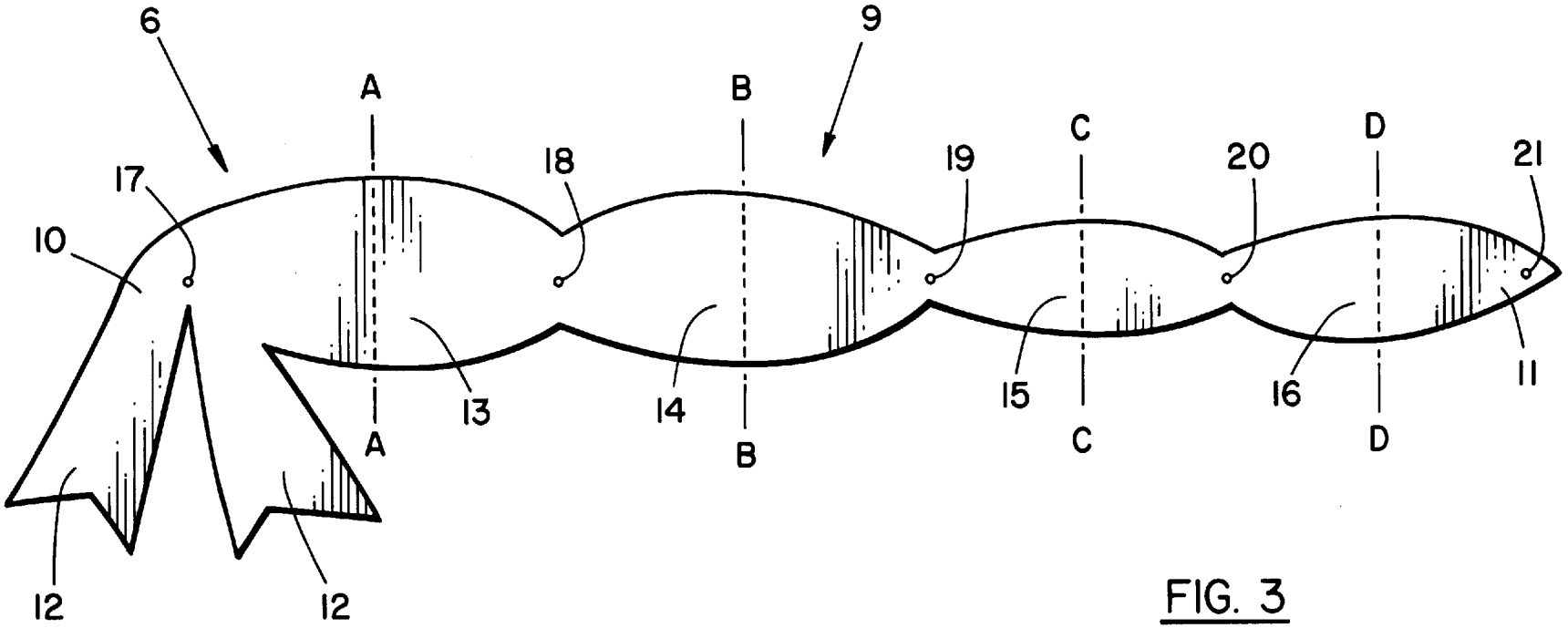
FIG. 3 is a reduced plan view of the pattern for the unfolded bow of FIG. 1.

The folded bow section 6 is best described with reference to FIG. 3. A pattern 9 is cut from a laminated substrate 2. A suitable pattern is illustrated in FIG. 3 but other patterns which can be folded to form a bow are within the scope of the invention. The pattern of FIG. 3 has a first end 10 and a second end 11. The first end 10 has a pair of tails 12 followed by a series of ovals 13, 14, 15 and 16. The ovals 13 to 16 are continuously decreasing in size from the largest 13 to the smallest 16. A series of small holes, 17, 18, 19, 20 and 21 are located on the longitudinal axis of the pattern. When the pattern is folded back and forth along lines A—A, B—B, C—C and D—D two bows 22 and 23 are formed so that holes 17 to 21 are aligned. When the bow section 6 is folded there is a small bow 23 overlying a large bow tie 22. The number of ovals is dictated by how full you want the resulting bow to look. The more ovals the fuller the appearance of the bow. To retain the folded bow section 6 in position, a small cap 7, preferably with the same basic shape and appearance as the folded bow section 6 is provided. A cord 8 is connected to the cap 7 and cord 8 fed through the series of holes 17–21 in the bow section 6. A drop 24 of glue or other retaining means can be applied to the back of bow section 6 to maintain the cord 8 in place. Cord 8 can be used to attach the bow to a gift box or other article. The cord is preferably selected from an elastic material for ease of use.

Figure 4:
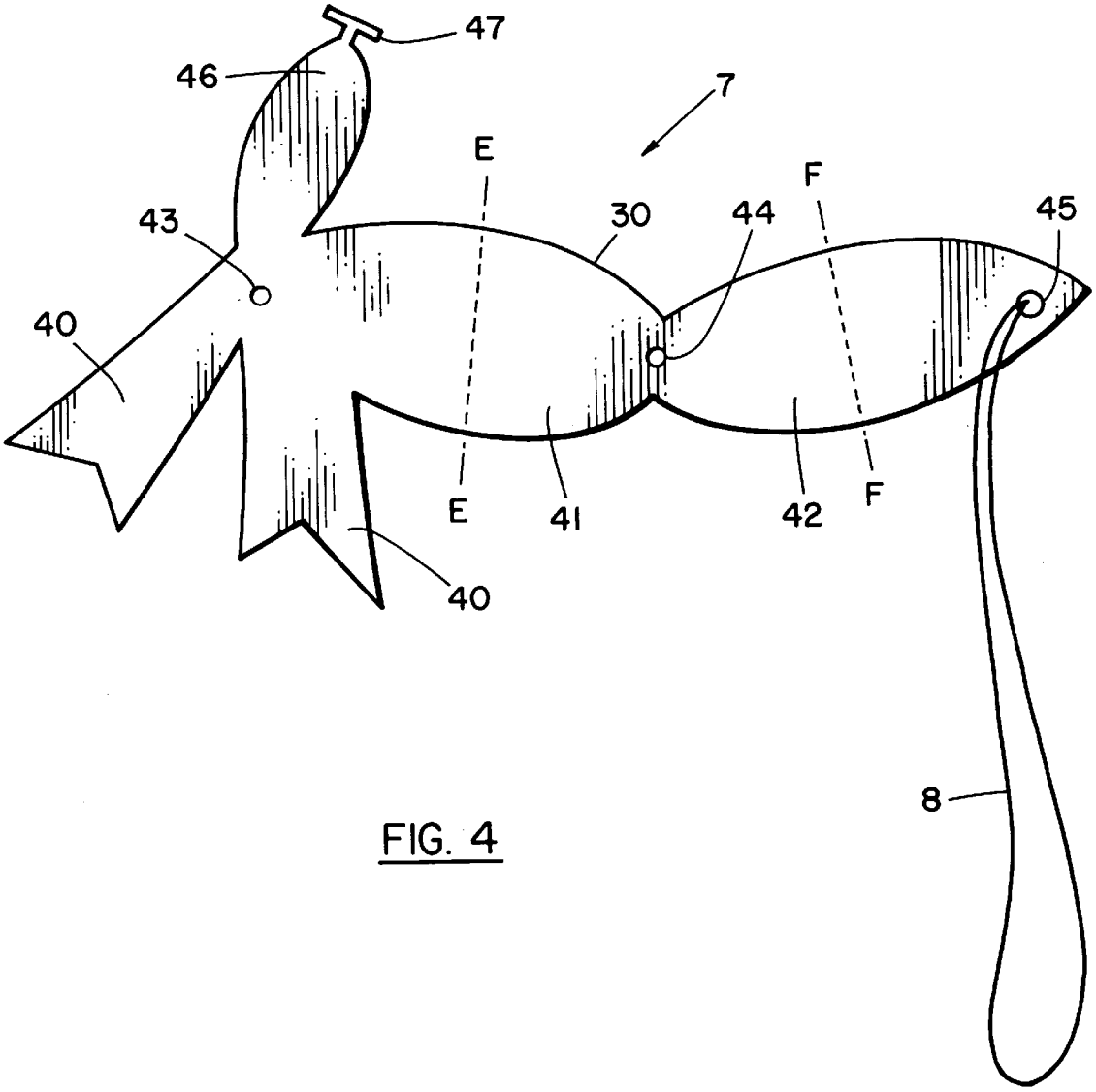
FIG. 4 is a plan view of a cap for the bow of FIG. 1.

The pattern for cap 7 is shown in FIG. 4. The pattern 30 has a pair of tails 40 and two ovals 41 and 42. Holes 43, 44 and 45 are provided. A closure flap 46 and locking tab 47 are also provided. The cap is folded in one direction along line E—E and then back in the other direction along line F—F to form a bow tie 48. Cord 8 is attached to the end of oval 42 adjacent hole 45. When the cap is folded to form the bow tie 48, cord 8 is passed through holes 44 and 43 which should now be aligned. Closure flap 46 is folded down over the series of holes and locked in place by putting locking tab 47 behind tails 40.

Different sizes and shapes of bows can be made by adjusting the shape and size of the pattern for the bow section and cap. Different folding angles also affect the shape of the resulting bow.

Figure 5:
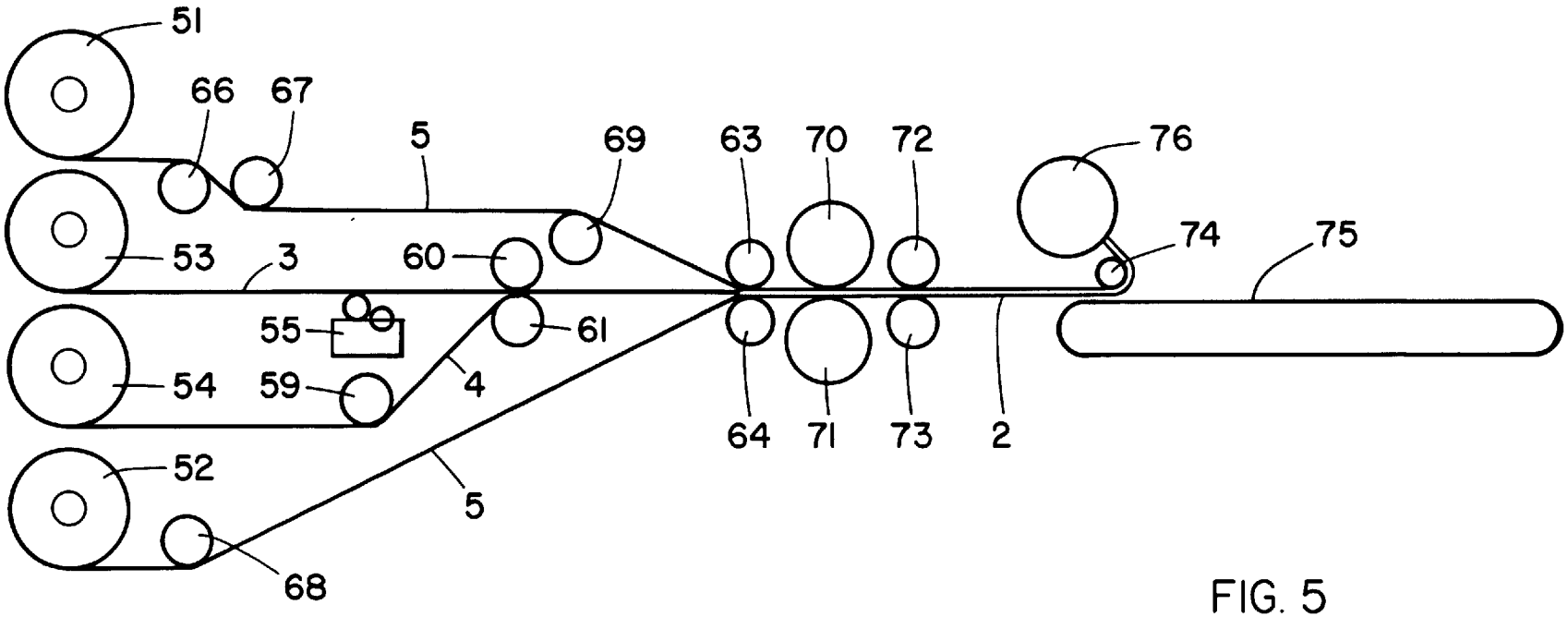
FIG. 5 is a schematic of one process according to the present invention for forming the decorative bow of FIG. 1.
Figure 6:
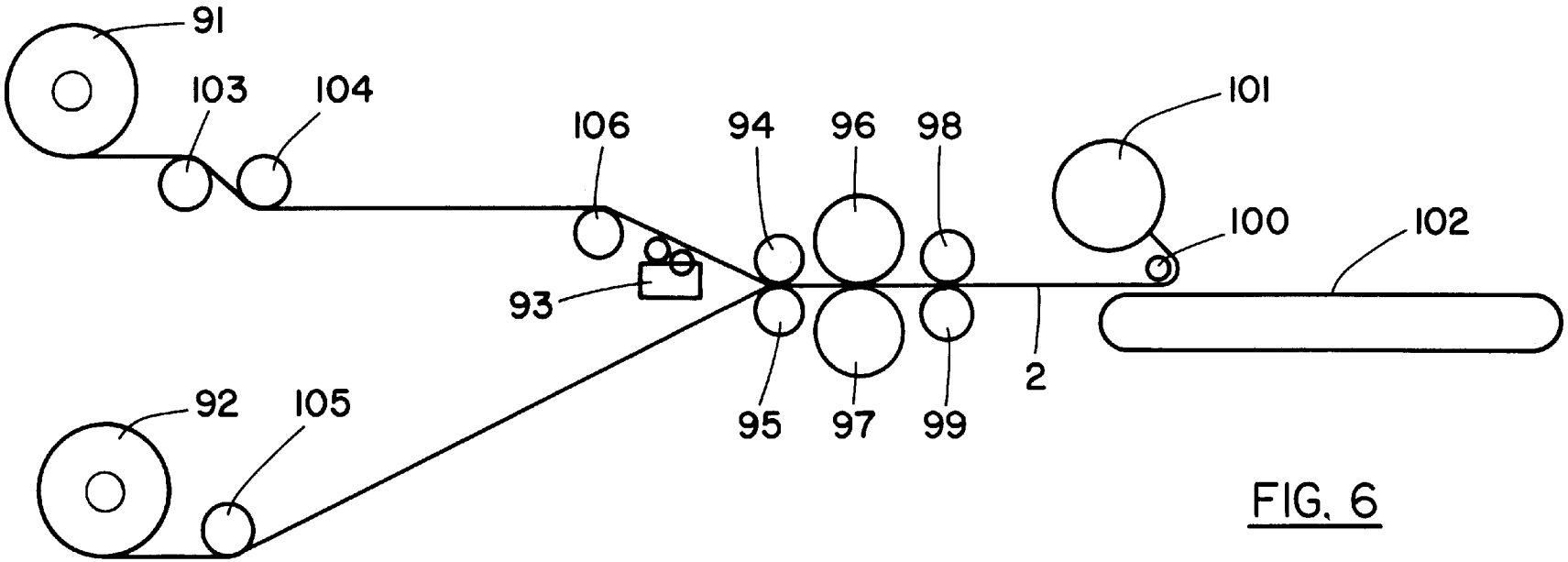
FIG. 6 is a schematic of another process according to the present invention of forming the bow of FIG. 1.

The laminated substrate 2 and the pattern 9 can be formed continuously as illustrated in FIG. 5 or 6. In FIG. 5 two reels 51 and 52 of film are provided in addition to two reels 53 and 54 of gift wrap paper or any other substrate printed on one side such as fabric etc. Reel 53 has the gift wrap print side up and reel 54 has the gift wrap print side down. The film and printed gift wrap are pulled over, under and or through a series of rolls to successively glue the gift wrap together, laminate the film to the printed side of the gift wrap, cut out the pattern for the bow and strip the scrap substrate from the cut out pattern. Glue application means 55 applies an adhesive to the unprinted side of the printed gift wrap from either reel 53 or 54. In FIG. 5 the adhesive is shown as applied to the unprinted side of the gift wrap from reel 53. Spreader roll(s) 59 is used to remove wrinkles in the gift wrap. The printed gift wrap from reels 53 and 54 after the glue application means pass through a pair of nip rolls 60 and 61 that pull and compress the two sheets together. The two glued together sheets of gift wrap and film laminate from reels 51 and 52 are then passed through a pair of heated nip rolls 63 and 64 to laminate the film laminate to both sides of the printed gift wrap. Upstream from these nip rolls 63 and 64, spreader rolls 66, 67, 68 and 69 are used to remove wrinkles in the film laminate. The laminated substrate is then pulled through a rotary die 70 and rotary die mandrill 71. The rotary die 70 cuts out the pattern for the bows and the rotary die mandrill 71 acts as the cutting surface for die 70. The die cut laminated substrate then passes through a pair of nip rolls 72 and 73 to make the final compression of the film laminates. A stripper roll 74 removes the cut out pattern from the surrounding substrate and deposits them on conveyor 75 to take the patterns to an assembly point. Scrap web rewinder 76 is used to rewind the left over substrate material.

FIG. 6 illustrates another method of making the laminated substrate 2 and pattern 9 according to the present invention. In this method the printed gift wrap or other substrate has already been laminated on the printed side with a laminate film, preferably polypropylene. As shown in FIG. 6 a roll of laminated printed gift wrap or other printed substrate 91 together with a second roll of laminated gift wrap or other printed substrate 92 are provided for the continuous lamination of the two substrates together, the die cutting of the pattern for the bows and the removal of scrap material. Roll 91 has the print side up and roll 92 has the print side down. The two sheets of laminated gift wrap are pulled through a series of rolls to successively glue the gift wrap together, cut out the pattern for the bow and strip the scrap material from the pattern. A glue means 93 is provided to apply glue or other adhesive to the unprinted side of one of the sheets of gift wrap. The two sheets of laminated gift wrap are then pulled through a pair of heated nip rolls 94 and 95 to laminate the two sheets together. The laminated gift wrap is then passed through a rotary die 96 and rotary die mandrill 97 that cut out the pattern for the bows. A second set of nip rolls 98 and 99 make the final compression of the laminated substrate 2. A stripper roll 100 is used to remove the patterns 9 from substrate 2. Scrap web rewinder 101 is used to rewind left over substrate. Conveyor 102 transports the cutout patterns to a bow assembly point. Numerous spreader rolls 103, 104, 105 and 106 are used to maintain the laminated gift wrap wrinkle free before the glue application stage.

Additions and modifications to the methods and apparatus as described above can be made without departing from the scope of the present invention.

Having illustrated and described a preferred embodiment of the invention and certain possible modifications thereto, it should be apparent to those of ordinary skill in the art that the invention permits of further modification in arrangement and detail. All such modifications are covered by the scope of the invention.

The embodiments of the invention in which an exclusive property or privilege is claimed are defined as follows:

1. A decorative bow formed from a folded pattern of a laminated substrate, said substrate comprising one or more layers of printed material laminated between two layers of laminate film whereby the printed material is adapted so that the print is visible on both sides of the substrate.

2. A decorative bow according to claim 1 wherein the layers of printed material are selected from the group consisting of paper, cardboard, fabric, vinyl, plastic or film.

3. A decorative bow according to claim 2 wherein the layers of printed material consist of two sheets of gift wrap paper.

4. A decorative bow according to claim 1 wherein the laminate film is polypropylene.

5. A decorative bow according to claim 1 comprising a folded bow section, a cap and cord means.

6. A decorative bow according to claim 5 wherein the folded bow section comprises a small bow tie overlying a larger bow tie.

7. A decorative bow according to claim 6 wherein said cap comprises a small bow tie to which said cord means is attached.

8. A decorative bow according to claim 7 wherein said cap locks the bow section in the folded position.

9. A method of making the decorative bow according to claim 1 comprising the steps of:

(a) cutting a pattern from a printed laminated substrate;

(b) folding said pattern along designated fold lines to form a bow;

(c) retaining said bow in a folded condition.

10. A method according to claim 9 wherein the layers of printed material are selected from the group consisting of paper, cardboard, fabric, vinyl, plastic or film.

11. A method according to claim 10 wherein the layers of printed material consist of two sheets of gift wrap paper.

12. A method according to claim 9 wherein the laminate film is polypropylene.

* * * * *